US005914444A

United States Patent [19]

Reinert et al.

[11] Patent Number: 5,914,444

[45] Date of Patent: Jun. 22, 1999

[54] PROCESS FOR INCREASING THE SUN PROTECTION FACTOR OF CELLULOSIC FIBER MATERIALS

[75] Inventors: Gerhard Reinert, Allschwil; Francesco Fuso, Therwil; Rolf Hilfiker, Allschwil, all of Switzerland

[73] Assignee: Ciba Specialty Chemicals Corporation, Tarrytown, N.Y.

[21] Appl. No.: 08/913,438

[22] PCT Filed: Mar. 4, 1996

[86] PCT No.: PCT/EP96/00896

§ 371 Date: Sep. 15, 1997

§ 102(e) Date: Sep. 15, 1997

[87] PCT Pub. No.: WO96/29461

PCT Pub. Date: Sep. 26, 1996

[30] Foreign Application Priority Data

Mar. 17, 1995 [CH] Switzerland ..... 770/95

[51] Int. Cl.[6] ..... D06P 3/62

[52] U.S. Cl. ..... 8/442; 8/490; 8/685; 8/688; 8/690; 8/661; 8/566; 8/570; 8/589

[58] Field of Search ..... 8/442, 490, 685, 8/688, 690, 661, 566, 570, 589

[56] References Cited

U.S. PATENT DOCUMENTS

| | | |
|---|---|---|
| 3,041,330 | 6/1962 | Coleman et al. . |
| 3,042,669 | 7/1962 | Boyle et al. . |
| 4,770,667 | 9/1988 | Evans et al. . |
| 4,775,386 | 10/1988 | Reinert et al. . |
| 4,831,068 | 5/1989 | Reinert et al. . |
| 5,197,991 | 3/1993 | Rembold . |
| 5,637,348 | 6/1997 | Thompson et al. . |
| 5,700,295 | 12/1997 | Fuso et al. . |
| 5,700,394 | 12/1997 | Isharani et al. . |

FOREIGN PATENT DOCUMENTS

| | | |
|---|---|---|
| 2384827 | 10/1978 | France . |
| 1344991 | 1/1974 | United Kingdom . |
| 2174731 | 11/1986 | United Kingdom . |
| 2248451 | 4/1992 | United Kingdom . |
| 2263912 | 8/1993 | United Kingdom . |
| 9404515 | 3/1994 | WIPO . |
| 94/18381 | 8/1994 | WIPO . |

OTHER PUBLICATIONS

Trotman, Dyeing and Chemical Technology of Textile Fibres, 6th edition, 1984, p. 353.

*Primary Examiner*—Margaret Einsmann
*Attorney, Agent, or Firm*—Kevin T. Mansfield; David R. Crichton

[57] ABSTRACT

Process for increasing the sun protection factor of cellulosic fibre materials by treating the cellulosic fibre materials with at least one direct dye and at least one UV absorber.

18 Claims, No Drawings

PROCESS FOR INCREASING THE SUN PROTECTION FACTOR OF CELLULOSIC FIBER MATERIALS

The present invention relates to a process for increasing the sun protection factor of cellulosic fibre materials, which comprises treating the cellulosic fibre materials with direct dyes in the presence of at least one UV absorber.

The skin-damaging effect of UV radiation is known. Protection from strong sunlight is usually sought by applying a sun cream, a composition that contains a UV absorber, directly to the skin. In particularly sunny climes, for example in Australia or America, however, the rate of skin damage due to UV radiation has lately been increasing. Accordingly, more attention is paid in these countries to protecting the skin from the sun's rays.

It has therefore been proposed that not only to protect the skin directly, but also to reduce the UV transmissivity of the clothing and also of other sun protection articles fabricated from cellulosic fibre materials, such as awnings or parasols. Most undyed fibre materials are at least partially transparent to UV radiation, so that the mere wearing of clothes does not offer adequate protection to the skin from damage due to UV radiation.

However, the results achieved hitherto in respect of the protection from UV radiation in the area of cellulosic fibre materials, in particular textile materials, have not been satisfactory and there therefore continues to be a need for improving the sun protection factor of these materials.

It has now been found, surprisingly, that even better sun protection can be achieved if cellulosic fibre materials are treated with a combination of direct dyes and UV absorbers.

The present invention accordingly provides a process for increasing the sun protection factor of cellulosic fibre materials, which comprises treating the cellulosic fibre materials with at least one direct dye and at least one UV absorber.

In the process of the present invention, the amounts in which the direct dyes are used in the dyebaths may vary with the desired depth of shade; in general, advantageous amounts range from 0.001 to 10% by weight, in particular from 0.001 to 5% by weight, based on the weight of the fibre material.

The amounts of UV absorbers used in the process of the present invention can vary between 0.001 and 5% by weight, based on the weight of the fibre material.

In a preferred embodiment of the process of the present invention, the amount of UV absorber used depends on the total amount of dye used. For instance, the amount of UV absorber used is from 0.2 to 5% by weight, in particular from 0.2 to 2% by weight, based on the weight of the fibre material, in the case of pale shades, from 0.05 to 0.2% by weight in the case of medium shades and from 0.001 to 0.05% by weight in the case of deep shades. Pale shades are to be understood as meaning those where the amount of dye used is from 0.001 to 0.2% by weight, based on the weight of the fibre material. Medium shades are those where the amount of dye used is from 0.2 to 2.0% by weight and deep shades are those where the amount of dye used is from 2 to 10% by weight, in particular from 2 to 5% by weight.

In a particularly preferred embodiment of the process of the present invention, the amount of direct dye used is from 0.2 to 2.0% by weight, based on the weight of the fibre material, and the amount of UV absorber used is from 0.05 to 0.2% by weight, based on the weight of the fibre material.

In a very particularly preferred embodiment of the process of the present invention, the amount of direct dye used is from 0.001 to 0.2% by weight, based on the weight of the fibre material, and the amount of UV absorber used is from 0.2 to 2% by weight, based on the weight of the fibre material.

The process of the present invention makes it possible to achieve an adequate sun protection factor in fibre material dyed or printed in any desired shade, an adequate sun protection factor being a sun protection factor with a value of at least 25.

Advantageously, the amount of direct dye used is selected so as to result in an increase of the sun protection factor of cellulosic fibre materials by at least a factor of 5.

Direct dyes are to be understood for example as meaning those dyes which are described as direct dyes in the Colour Index, 3rd edition (3rd revision 1987 including additions and amendments up to No. 85).

The direct dyes used are in particular phthalocyanine dyes, dioxazine dyes and dyes of the formula $$A_1—B_1—A_2 \quad (1)$$

where $B_1$ is a bridge member and $A_1$ and $A_2$ are independently of each other the radical of a monoazo, polyazo, metal complex azo, stilbene or anthraquinone dye, or where $B_1$ and $A_1$ are each as defined above and $A_2$ is a phenyl or naphthyl radical substituted by a heterocyclic radical or by a benzoylamino or phenylamino radical, or where $B_1$ is a direct bond and $A_1$ and $A_2$ are each the radical of a metal complex azo dye.

Suitable bridge members $B_1$ in the formula (1) include for example:

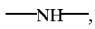
(2a)

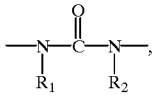
(2b)

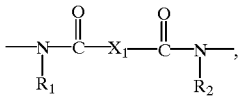
(2c)

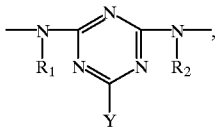
(2d)

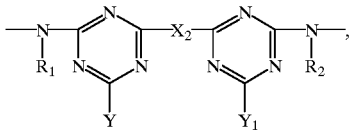
(2e)

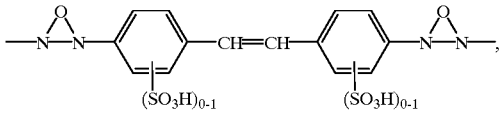
(2f)

-continued (2g)

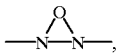

(2h)

and (2i)

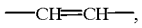

where $R_1$ and $R_2$ are independently of each other unsubstituted or halogen-, hydroxyl-, cyano-, $C_1$–$C_4$alkoxy-, $C_1$–$C_4$alkoxycarbonyl-, carboxyl-, sulfamoyl-, sulfo- or sulfato-substituted $C_1$–$C_8$alkyl; or in particular hydrogen; $X_1$ and $X_2$ are each bridge members; and Y and $Y_1$ are independently of each other hydroxyl, $C_1$–$C_4$alkoxy, chlorine, bromine, $C_1$–$C_4$alkylthio, amino, unsubstituted or hydroxyl-, sulfo-, carboxyl- or $C_1$–$C_4$alkoxy-substituted (in the alkyl moiety) N-mono- or N,N-di-$C_1$–$C_4$alylamino, cyclohexylamino, unsubstituted or $C_1$–$C_4$alkyl, $C_1$–$C_4$alkoxy-, carboxyl-, sulfo- and/or halogen-substituted (in the phenyl moiety) phenylamino or N-$C_1$–$C_4$alkyl-N-phenylamino, morpholino or 3-carboxy- or 3-carbamoyl-pyridin-1-yl.

The bridge member $X_1$ in the formula (2c) is preferably unsubstituted or hydroxyl-, sulfo-, sulfato-, $C_1$–$C_4$alkoxy-, carboxyl- or halogen-substituted C2-$C_6$alkylene; unsubstituted or hydroxyl-, sulfo-, sulfato-, $C_1$–$C_4$alkoxy-, carboxyl- or halogen-substituted $C_5$–$C_9$cycloalkylene; unsubstituted or $C_1$–$C_4$alkyl-, $C_1$–$C_4$-alkoxy-, sulfo-, halogen- or carboxyl-substituted phenylene; unsubstituted or $C_1$–$C_4$alkyl-, $C_1$–$C_4$-alkoxy-, sulfo-, halogen- or carboxyl-substituted biphenylene; or unsubstituted or $C_1$–$C_4$alkyl-, $C_1$–$C_4$-alkoxy-, sulfo-, halogen- or carboxyl-substituted naphthalene radical. $X_1$ is in particular unsubstituted or sulfo-substituted phenylene.

A bridge member $X_2$ in the formula (2e) can be for example a radical of the formula (3a)

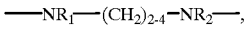

(3b)

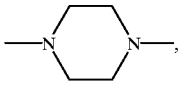

(3c)

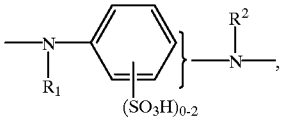

(3d)

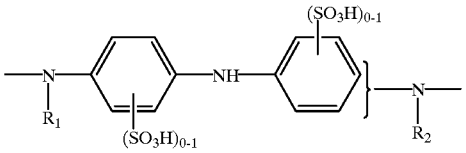

and in particular (3e)

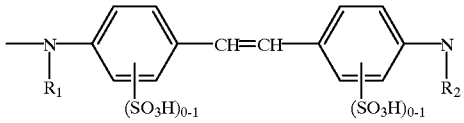

where $R_1$ and $R_2$ are each subject to the previously indicated definitions and preferences.

Preference is given to the use of direct dyes of the formula $$A_1—NH—L_1 \quad (1a)$$

where $A_1$ is as defined under the formula (1) and $L_1$ is a radical of the formulae

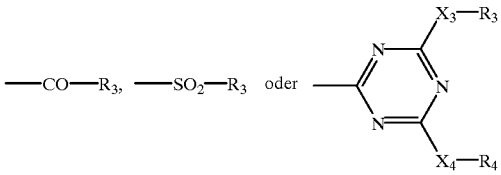

where $X_3$ and $X_4$ are independently of each other a direct bond, NH, $NR_5$, O or S; $R_3$ and $R_4$ are independently of each other hydrogen; aromatic, aliphatic or cycloaliphatic radicals, which are unsubstituted or substituted by halogen, $OR_5$, $COOR_5$, $SO_3H$ or aralkyl, which may be substituted by halogen, $OR_5$, $COOR_5$ or $SO_3H$; and $R_5$ is hydrogen or $C_1$–$C_6$alkyl.

The radicals $R_3$ and $R_4$ in the formula (1a) are preferably $C_1$–$C_6$alkyls or $C_1$–$C_6$alkylenes, for example methyl, ethyl or isopropyl, which may each be substituted, for example by carboxyl or phenyl; or phenols, which may likewise be substituted, for example by carboxyl; unsubstituted or substituted benzyl radicals; or radicals of the formulae

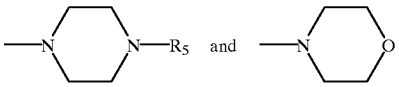

where $R_5$ is as defined under the formula (1a).

Preference is likewise given to using dyes of the formula (1) where $B_1$ and $A_1$ are each as defined and $A_2$ is a benzothiazolyl-, benzisothiazolyl- or naphthotriazolyl-substituted phenyl radical, where the phenyl radical and the benzothiazolyl, benzisothiazolyl and naphthotriazolyl substituents on the phenyl radical can independently of one another be substituted by $C_1$–$C_4$alkyl, $C_1$–$C_4$alkoxy, halogen, carboxyl, hydroxyl, sulfo, sulfamoyl, ureido, amino optionally further substituted by $C_1$–$C_4$alkyl, $C_1$–$C_4$hydroxyalkyl, or $C_2$–$C_6$alkanoyl or $C_2$–$C_6$alkanoylamino optionally further substituted (in the alkyl moiety) by hydroxyl.

The radicals $A_1$ and $A_2$ in the formula (1) can be substituted, for example by $C_1$–$C_4$alkyl, such as methyl, ethyl, propyl, isopropyl or butyl; $C_1$–$C_4$alkoxy, such as methoxy, ethoxy, propoxy, isopropoxy or butoxy; $C_1$–$C_8$acylamino, in particular unsubstituted or hydroxyl-substituted (in the alkyl moiety) $C_1$–$C_8$alkanoylamino, such as acetylamino or propionylamino; unsubstituted or hydroxyl-substituted (in the alkyl moiety) $C_1$–$C_8$alkoxycarbonylamino, such as methoxycarbonylamino or ethoxycarbonylamino; benzoylamino; phenylamino, N,N-di-β-hydroxyethylamino; N,N-di-β-sulfatoethylamino; sulfobenzylamino; N,N-disulfobenzylamino; unsubstituted or hydroxyl-substituted (in the alkyl moiety) $C_2$–$C_6$alkanoyl; phenylazo; naphthotriazolyl; benzothiazolyl; benzisothiazolyl; $C_1$–$C_4$alkoxycarbonyl, such as methoxycarbonyl or ethoxycarbonyl; $C_1$–$C_4$alkylsulfonyl, such as methylsulfonyl or ethylsulfonyl; trifluoromethyl; nitro; cyano; halogen, such as fluorine, chlorine or bromine; carbamoyl, N-$C_1$–$C_4$alkylcarbamoyl, such as N-methylcarbamoyl or N-ethylcarbamoyl; sulfamoyl; N-$C_1$–$C_4$alkylsulfamoyl, such as N-methylsulfamoyl, N-ethylsulfamoyl, N-propylsulfamoyl, N-isopropylsulfamoyl or N-butylsulfamoyl; N-phenylsulfamoyl; ureido; hydroxyl; carboxyl; sulfomethyl; sulfo; or unsubstituted or $C_1$–$C_4$alkyl- or $C_1$–$C_4$hydroxyalkyl-substituted amino; where the abovementioned heterocyclic radicals and also the groups that contain a phenyl radical can be further substituted by one or more of the groups mentioned above as substituents for the radicals $A_1$ and $A_2$.

Any $C_1$–$C_4$alkyl, $C_1$–$C_6$alkyl or $C_1$–$C_8$alkyl in the formulae is for example, in accordance with the stated chain length, methyl, ethyl, n-propyl, isopropyl, n-butyl, isobutyl, sec-butyl, tert-butyl, pentyl, hexyl, heptyl or octyl.

Any $C_1$–$C_4$alkoxy in the formulae is for example methoxy, ethoxy, propoxy, isopropoxy, isobutoxy or tert-butoxy.

Any $C_1$–$C_4$hydroxyalkyl in the formulae is for example 2-hydroxyethyl, 2-hydroxypropyl, 3-hydroxypropyl, 2-hydroxybutyl, 3-hydroxybutyl, 4-hydroxybutyl, 2,3-dihydroxypropyl or 3,4-dihydroxybutyl.

Any N-mono-$C_1$–$C_4$alkylamino in the formulae is for example N-methylamino, N-ethylamino, N-propylaminio or N-butylamino.

Any N,N-di-$C_1$–$C_4$alkylamino in the formulae is for example N,N-dimethylamino, N,N-diethylamino, N,N-dipropylamino, N-methyl-N-ethylamino, N-ethyl-N-propylamino or N-ethyl-N-butylamino.

Any N-$C_1$–$C_4$alkyl-N-phenylamino in the formulae is for example N-methyl-N-phenylamino, N-ethyl-N-phenylamino, N-propyl-N-phenylamino or N-butyl-N-phenylamino.

Any $C_2$–$C_6$alkanoylamino or $C_1$–$C_8$alkanoylamino in the formulae is for example acetylamino, propionylamino or n-butyrylamino.

Any $C_1$–$C_4$alkoxycarbonyl in the formulae is for example methoxycarbonyl, ethoxycarbonyl or propoxycarbonyl.

Any $C_2$–$C_6$alkylene in the formulae is for example methylene, ethylene, propylene, tetramethylene, pentamethylene or hexamethylene.

Any $C_5$–$C_9$cycloalkylene in the formulae is for example cyclopentylene, cyclohexylene or cycloheptylene.

Any $C_2$–$C_6$alkanoyl in the formulae is for example acetyl, propionyl or n-butyryl.

Any $C_1$–$C_4$alkylthio in the formulae is for example methylthio, ethylthio, propylthio or butylthio.

Azo dye radicals $A_1$ and $A_2$ are preferably radicals of the formula

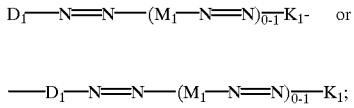

(4a)

or (4b)

where $D_1$ is the radical of a diazo component of the benzene or naphthalene series, $M_1$ is the radical of a middle component of the benzene or naphthalene series, $K_1$ is the radical of a coupling component of the benzene or naphthalene series, and $D_1$, $M_1$ and $K_1$ may be substituted by the substituents indicated above for $A_1$ and $A_2$, in particular by $C_1$–$C_4$alkyl, $C_1$–$C_4$alkoxy, halogen, carboxyl, hydroxyl, sulfo, sulfamoyl, ureido, unsubstituted or $C_1$–$C_4$alkyl- or $C_1$–$C_4$hydroxyalkyl-substituted amino, unsubstituted or hydroxyl-substituted (in the alkyl moiety) $C_2$–$C_6$alkanoyl, unsubstituted or hydroxyl-substituted (in the alkyl moiety) $C_2$–$C_6$alkanoylamino, unsubstituted or carboxyl-, halogen-, sulfo-, $C_1$–$C_4$alkyl- or $C_1$–$C_4$alkoxy-substituted (in the phenyl ring) phenylamino, or unsubstituted or carboxyl-, halogen-, sulfo-, $C_1$–$C_4$alkyl- or $C_1$–$C_4$alkoxy-substituted (in the phenyl ring) benzoylamino;

Metal complex azo dye radicals $A_1$ and $A_2$ are preferably radicals of the formula

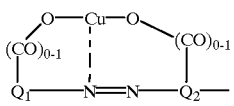

(5a)

or

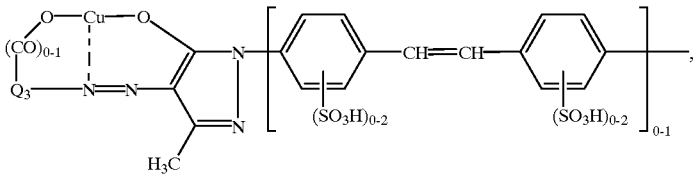

(5b)

where the oxygen or the carboxyl group is bonded to the radical $Q_1$, $Q_2$ or $Q_3$ in an ortho position relative to the azo group and $Q_1$, $Q_2$ or $Q_3$ are each independently of the others a radical of the benzene or naphthalene series, and $Q_1$, $Q_2$ and $Q_3$ may be substituted by the substituents indicated above for $A_1$ and $A_2$, in particular by $C_1$–$C_4$alkyl, $C_1$–$C_4$alkoxy, halogen, carboxyl, hydroxyl, sulfo, sulfamoyl, ureido, unsubstituted or $C_1$–$C_4$alkyl- or $C_1$–$C_4$hydroxyalkyl-substituted amino, unsubstituted or hydroxyl-substituted (in the alkyl moiety) $C_2$–$C_6$alkanoyl, unsubstituted or hydroxyl-substituted (in the alkyl moiety) $C_2$–$C_6$alkanoylamino, unsubstituted or carboxyl-, halogen-, hydroxyl-, sulfo-, $C_1$–$C_4$alkyl-, $C_1$–$C_4$alkoxy- or $C_1$–$C_4$carboxyalkoxy-substituted (in the phenyl ring) phenylamino, or unsubstituted or carboxyl-, halogen-, hydroxyl-, sulfo-, $C_1$–$C_4$alkyl-, $C_1$–$C_4$alkoxy- or $C_1$–$C_4$carboxyalkoxy-substituted (in the phenyl ring) benzoylamino, or unsubstituted or carboxyl-, halogen-, hydroxyl-, sulfo-, $C_1$–$C_4$alkyl-, $C_1$–$C_4$alkoxy- or $C_1$–$C_4$carboxyalkoxy-substituted (in the phenyl ring) phenylazo;

Stilbene dye radicals $A_1$ and $A_2$ are preferably radicals of the formula (6)

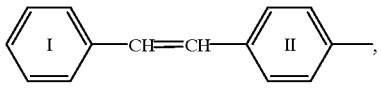

where the benzene rings I and II may independently of each other be substituted by the substituents indicated above for $A_1$ and $A_2$, in particular by $C_1$–$C_4$alkyl, $C_1$–$C_4$alkoxy, halogen, carboxyl, hydroxyl, sulfo, sulfamoyl, ureido, unsubstituted or $C_1$–$C_4$alkyl- or $C_1$–$C_4$hydroxyalkyl-substituted amino, unsubstituted or hydroxyl-substituted (in the alkyl moiety) $C_2$–$C_6$alkanoyl, unsubstituted or hydroxyl-substituted (in the alkyl moiety) $C_2$–$C_6$alkanoylamino, or unsubstituted or $C_1$–$C_4$alkyl-, $C_1$–$C_4$alkoxy-, halogen- or sulfo-substituted naphthotriazole;

Anthraquinone dye radicals $A_1$ and $A_2$ are preferably radicals of the formula (7)

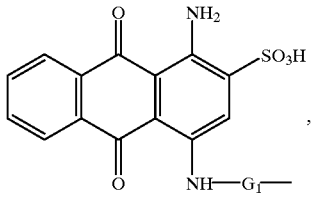

where $G_1$ is $C_2$–$C_6$alkylene, cyclohexylene, phenylenemethylene or preferably phenylene, the anthraquinone nucleus may be substituted by a further sulfo group, and phenylene $G_1$ may be substituted by $C_1$–$C_4$alkyl, $C_1$–$C_4$alkoxy, halogen, carboxyl or in particular sulfo;

A heterocyclyl-substituted phenyl or naphthyl radical $A_2$ is preferably a benzothiazolyl-, benzisothiazolyl- or naphthotriazolyl-substituted phenyl radical, where the phenyl radical and the benzothiazolyl, benzisothiazolyl and naphthotriazolyl substituents on the phenyl radical can independently of one another be substituted by $C_1$–$C_4$alkyl, $C_1$–$C_4$alkoxy, halogen, carboxyl, hydroxyl, sulfo, sulfamoyl, ureido, amino optionally further substituted by $C_1$–$C_4$alkyl or $C_1$–$C_4$hydroxyalkyl, or $C_2$–$C_6$alkanoyl or $C_2$–$C_6$alkanoylamino optionally further substituted (in the alkyl moiety) by hydroxyl.

Dyes of the formula (1) where $B_1$ is a bridge member may contain identical or different radicals of the formulae (4a), (4b), (5a), (5b), (6) and (7) for $A_1$ and $A_2$. Similarly, dyes of the formula (1) where $B_1$ is a direct bond may contain identical or different radicals of the formulae (5a) and (5b) for $A_1$ and $A_2$.

The phthalocyanine direct dyes suitable for the use according to the present invention preferably contain the radical of the formula (8)

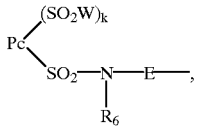

where Pc is the radical of a copper or nickel phthalocyanine, W is —OH and/or —$NR_7R_8$, $R_7$ and $R_8$ are independently of each other hydrogen or unsubstituted or hydroxyl- or sulfo-substituted $C_1$–$C_4$alkyl, $R_6$ is hydrogen or $C_1$–$C_4$alkyl, E is unsubstituted or $C_1$–$C_4$alkyl-, halogen-, carboxyl- or sulfo- substituted phenylene, or a $C_2$–$C_6$alkylene, preferably a sulphophenylene or ethylene, and k is 1, 2 or 3.

The dioxazine direct dyes suitable for the use according to the present invention preferably contain the radicals of the formulae (9a)

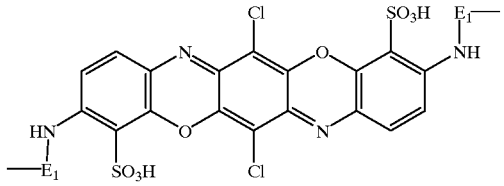

or (9b)

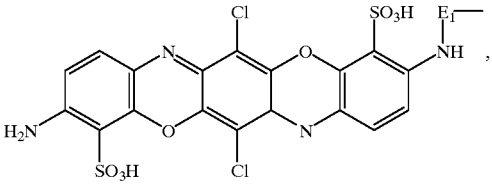

where $E_1$ is unsubstituted or $C_1$–$C_4$alkyl-, halogen-, carboxyl- or sulfo-substituted phenylene or a $C_2$–$C_6$alkylene; and the outer benzene rings in the formulae (9a) and (9b) may be further substituted by $C_1$–$C_4$alkyl, $C_1$–$C_4$alkoxy, acetylamino, nitro, halogen, carboxyl or sulfo.

Particular preference is given to using direct dyes of the formula (1) where $B_1$ is a bridge member of the formulae (2a) to (2i) and $A_1$ and $A_2$ are independently of each other a radical of the formulae (4a), (4b), (5a), (5b), (6) and (7) or direct dyes of the formula (1) where $B_1$ and $A_1$ are each as defined and $A_2$ is a benzothiazolyl-, benzisothiazolyl- or naphthotriazolyl-substituted phenyl radical, where the phenyl radical and the benzothiazolyl, benzisothiazolyl and naphthotriazolyl substituents on the phenyl radical can independently of one another be substituted by $C_1$–$C_4$alkyl, $C_1$–$C_4$alkoxy, halogen, carboxyl, hydroxyl, sulfo, sulfamoyl, ureido, amino optionally further substituted by $C_1$–$C_4$alkyl, $C_1$–$C_4$hydroxyalkoxy, or $C_2$–$C_6$alkanoyl or $C_2$–$C_6$alkanoylamino optionally further substituted (in the alkyl moiety) by hydroxyl. or direct dyes of the formula (1) where $B_1$ is a direct bond and $A_1$ and $A_2$ are independently of each other a radical of the formulae (5a) and (5b).

Particular preference is likewise given to using direct dyes of the formula (1a) where $L_1$ is a radical of the formulae

—$COCH_3$, —$COCH_2CH_2COOH$,

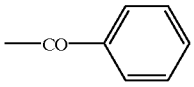

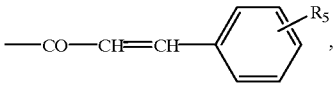

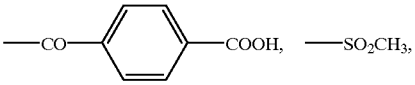

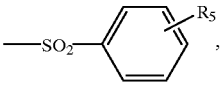

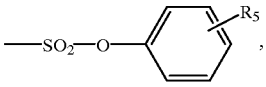

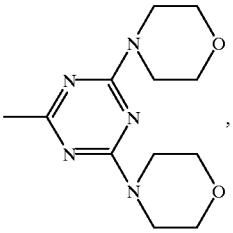

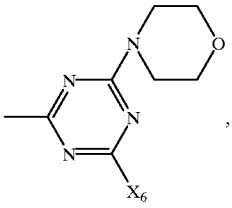

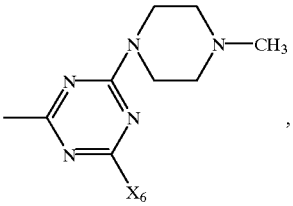

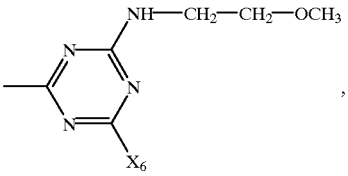

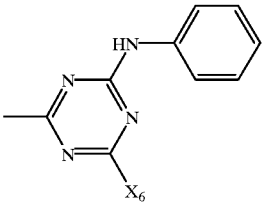

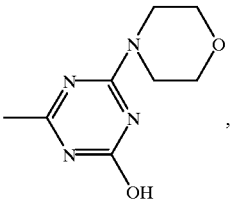

-continued

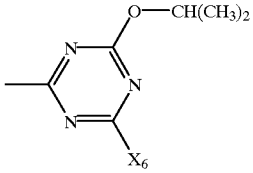

and

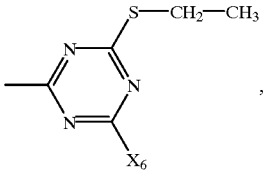

where $X_6$ is halogen and $R_5$ is as defined under the formula (1a).

The direct dyes preferably contain at least one water-solubilizing group, such as a sulfo or sulfato group, and are in this case present either in the form of their free acid or preferably as salts thereof, for example the alkali metal, alkaline earth metal or ammonium salts, or as salts of an organic amine. Examples are the sodium, potassium, lithium or ammonium salts or the salt of triethanolamine.

The direct dyes are known or can be prepared analogously to known dyes.

UV absorbers suitable for the process of the present invention are for example water-solubilized UV absorbers as known for example from U.S. Pat. No. 4,141,903; U.S. Pat. No. 4,230,867; U.S. Pat. No. 4,698,064 and U.S. Pat. No. 4,770,667.

It is possible to use for example the following compounds:

a) 2-hydroxybenzophenones of the formula (10)

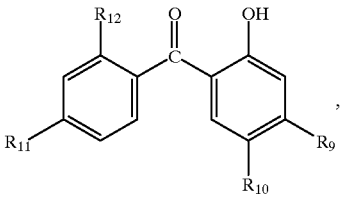

where $R_9$ is hydrogen, hydroxyl, $C_1$–$C_{14}$alkoxy or phenoxy, $R_{10}$ is hydrogen, halogen, $C_1$–$C_4$alkyl or sulfo, $R_{11}$ is hydrogen, hydroxyl or $C_1$–$C_4$alkoxy, and $R_{12}$ is hydrogen, hydroxyl or carboxyl;

b) 2-(2'-hydroxyphenyl)-benzotriazoles of the formula (11)

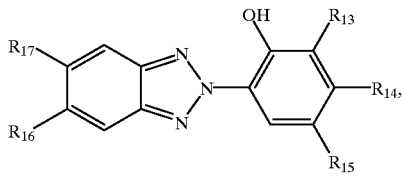

$R_{13}$ is hydrogen, chlorine, sulfo, $C_1$–$C_{12}$alkyl, $C_5$–$C_6$cycloalkyl, ($C_1$–$C_8$alkyl)phenyl, $C_7$–$C_9$phenylalkyl or sulfonated $C_7$–$C_9$phenylalkyl, $R_{14}$ is hydrogen, chlorine, $C_1$–$C_4$alkyl, $C_1$–$C_4$alkoxy, hydroxyl or sulfo, $R_{15}$ is $C_1$–$C_{12}$alkyl, chlorine, sulfo, $C_1$–$C_4$alkoxy, phenyl, ($C_1$–$C_8$alkyl)phenyl, $C_5$–$C_6$cycloalkyl, $C_2$–$C_9$alkoxycarbonyl, carboxyethyl, $C_7$–$C_9$phenylalkyl or sulfonated $C_7$–$C_9$phenylalkyl, $R_{16}$ is hydrogen, chlorine, $C_1$–$C_4$alkyl, $C_1$–$C_4$alkoxy, $C_2$–$C_9$alkoxycarbonyl, carboxyl or sulfo, and $R_{17}$ is hydrogen or chlorine;

c) 2-(2'-hydroxyphenyl)-s-triazines of the formula (12)

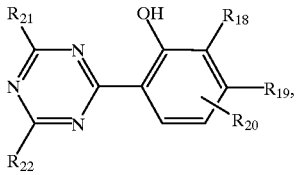

where $R_{18}$ is hydrogen, halogen, $C_1$–$C_4$alkyl or sulfo, $R_{19}$ is hydrogen, $C_1$–$C_4$alkyl, $C_1$–$C_4$alkoxy or hydroxyl, $R_{20}$ is hydrogen or sulfo, and $R_{21}$ and $R_{22}$ are independently of each other $C_1$–$C_4$alkyl, $C_1$–$C_4$alkoxy, $C_5$–$C_6$cycloalkyl, phenyl or $C_1$–$C_4$alkyl- and/or hydroxyl-substituted phenyl;

d) s-triazine compounds of the formula (13)

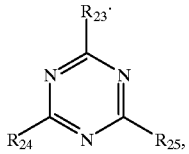

where at least one of the substituents $R_{23}$, $R_{24}$ and $R_{25}$ is a radical of the formula (14)

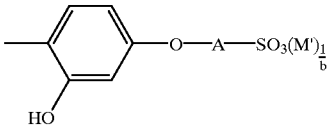

where A is $C_3$–$C_4$alkylene or 2-hydroxytrimethylene and M' is sodium, potassium, calcium, magnesium, ammonium or tetra-$C_1$–$C_4$alkylammonium and b is 1 or 2, and the remaining substituent is or the remaining substituents are independently of each other $C_1$–$C_{12}$alkyl, phenyl, $C_1$–$C_{12}$alkyl or phenyl attached to the triazinyl radical by oxygen, sulfur, imino or $C_1$–$C_{11}$alkylimino, or a radical of the formula (14), for example the potassium salt of the compound of the formula (13) where $R_{23}$ is phenyl and $R_{24}$ and $R_{25}$ are each the radical of the formula (14) or the sodium salt of the compound of the formula (13) where $R_{23}$ is p-chlorophenyl and $R_{24}$ and $R_{25}$ are each the radical of the formula (14).

$C_1$–$C_{14}$Alkoxy $R_9$is for example methoxy, ethoxy, propoxy, n-butoxy, octyloxy, dodecyloxy or tetradecyloxy;

$C_1$–$C_4$Alkyl $R_{10}$, $R_{14}$, $R_{16}$, $R_{18}$, $R_{19}$, $R_{21}$ or $R_{22}$ is methyl, ethyl, propyl, isopropyl, n-butyl, isobutyl, sec-butyl or tert-butyl;

Sulfo $R_{10}$, $R_{13}$, $R_{14}$, $R_{15}$, $R_{16}$, $R_{18}$ or $R_{20}$ is present in free form or in salt form, for example as alkali metal, alkaline earth metal, ammonium or amine salts.

$C_1$–$C_4$Alkoxy $R_{11}$, $R_{14}$, $R_{15}$, $R_{16}$, $R_{19}$, $R_{21}$ or $R_{22}$ is for example methoxy, ethoxy, n-propoxy, isopropoxy, n-butoxy, isobutoxy, sec-butoxy or tert-butoxy;

Carboxyl $R_{12}$ or $R_{16}$ may be present in free form or in salt form, for example as alkali metal, alkaline earth metal, ammonium or amine salt.

$C_5$–$C_6$Cycloalkyl $R_{13}$, $R_{15}$, $R_{21}$ or $R_{22}$ is for example cyclopentyl or cyclohexyl;

($C_1$–$C_8$alkyl)phenyl, for example methylphenyl, tert-butylphenyl, tert-amylphenyl or tert-octylphenyl;

$C_1$–$C_{12}$alkyl $R_{13}$, $R_{15}$, $R_{23}$, $R_{24}$ or $R_{25}$ is for example methyl, ethyl, amyl, tert-octyl, n-dodecyl, sec-butyl or tert-butyl;

$C_7$–$C_9$phenylalkyl $R_{13}$ or $R_{15}$ is for example benzyl, α-methylbenzyl or preferably α,α-dimethylbenzyl;

$C_2$–$C_9$alkoxycarbonyl $R_{15}$ or $R_{16}$ is for example ethoxycarbonyl, n-octoxycarbonyl or preferably methoxycarbonyl;

$C_1$–$C_{11}$alkylamino $R_{23}$, $R_{24}$ or $R_{25}$ is for example methyl-, ethyl-, butyl-7, hexyl-, octyl-, decyl- or undecylimino.

(e) Water-soluble, asymmetrical oxalic diarylamides of the formula (15)

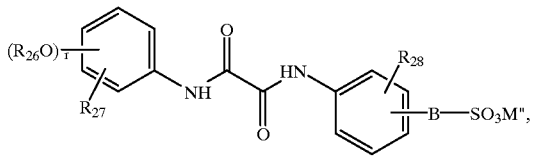

where $R_{26}$ is unsubstituted or hydroxyl- or alkoxy-substituted $C_1$–$C_5$alkyl or unsubstituted or $C_1$–$C_5$alkyl-substituted benzyl; $R_{27}$ is hydrogen; halogen; $C_1$–$C_{12}$alkyl or phenyl-$C_1$–$C_5$alkyl; $R_{28}$ is hydrogen; halogen; $C_1$–$C_{12}$alkyl, phenyl-$C_1$–$C_5$alkyl or $C_1$–$C_5$alkoxy; B is a direct bond or a bivalent radical of the formula —O—L—, where L is unsubstituted or hydroxyl-substituted $C_1$–$C_6$alkylene; M" is hydrogen or an alkali metal and r is 2; 1 or 0.

A $C_1$–$C_5$alkyl $R_{26}$ is for example methyl, ethyl, n-propyl, isopropyl, n-butyl, sec-butyl, tert-butyl, amyl or isoamyl;

a halogen $R_{27}$ or $R_{28}$ is for example fluorine, bromine or chlorine. Chlorine is preferred. $C_1$–$C_{12}$Alkyl radicals $R_{27}$ and $R_{28}$ can be branched or unbranched radicals, for example methyl, ethyl, n-propyl, isopropyl, n-butyl, sec-butyl, tert-butyl, amyl, isoamyl, pentyl, neopentyl, tert-pentyl, hexyl, isohexyl, heptyl, octyl, isooctyl, nonyl, decyl, undecyl or dodecyl.

A phenyl-$C_1$–$C_5$alkyl $R_{27}$ or $R_{28}$ is for example phenethyl, phenylpropyl, phenylbutyl or preferably benzyl.

A $C_1$–$C_5$alkoxy $R_{28}$ is for example methoxy, ethoxy, isopropoxy, isobutoxy, tert-butoxy or tert-amyloxy.

A $C_1$–$C_6$alkylene L is a bivalent, saturated hydrocarbon radical, for example methylene, ethylene, propylene, trimethylene, tetramethylene, ethylethylene, pentamethylene or hexamethylene.

An alkali metal M" is for example lithium, sodium or potassium. Sodium is preferred.

The UV absorber of the formula (15) is preferably a compound where L is trimethylene or

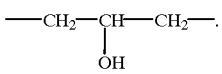

A further preferred oxalic diarylamide conforms to the previously indicated formula (15) where $R_{28}$ is $C_1$–$C_{12}$alkyl or $C_1$–$C_5$alkoxy.

A similarly preferred UV absorber (e) is a compound of the previously indicated formula (15) where $R_{26}$ is $C_1$–$C_3$alkyl; $R_{27}$ is hydrogen; $C_1$–$C_3$alkyl or $C_1$–$C_3$alkoxy; $R_{28}$ is hydrogen; $C_1$–$C_3$alkyl or $C_1$–$C_3$alkoxy; B is a direct bond or the radical —[O—$(CH_2)_3$]$_s$; r is 0; 1 or 2;and s is 0 or 1.

A very particularly preferred UV absorber (e) is a compound of the formula (15) where r is 0 or 1, $R_{26}$ is methyl; ethyl; methoxy or ethoxy; $R_{27}$ is hydrogen or ethyl; $R_{28}$ is hydrogen or $C_1$–$C_3$alkoxy; B is the radical —[O—$(CH_2)_3$]$_s$ and s is 0 or 1.

Emphasis for use as UV absorber (e) is given in particular to the compound of the formula (15a)

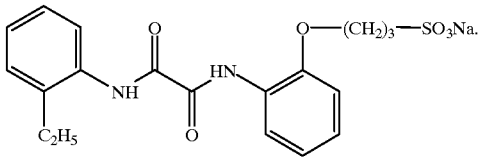

The oxalic diarylamides according to (e) are known for example from EP-A 0 507 732 or can be obtained by the methods indicated therein.

Preferably the UV absorbers used in the process of the present invention are reactive UV absorbers.

Reactive UV absorbers are to be understood as meaning those UV absorbers which contain one or more reactive groups. Reactive groups are to be understood as meaning fibre-reactive radicals which are capable of reacting with the hydroxyl groups of cellulose, the amino, carboxyl, hydroxyl and thiol groups of wool and silk or with the amino and possibly carboxyl groups of synthetic polyamides to form covalent chemical bonds. The reactive groups are generally bonded to the UV absorber radical directly or via a bridge member. Suitable reactive groups are for example those which contain at least one detachable substituent attached to an aliphatic, aromatic or heterocyclic radical or in which the radicals mentioned contain a radical suitable for reaction with the fibre material, for example a triazine radical.

Suitable further reactive groups include those which contain at least one activated unsaturated group, in particular an unsaturated aliphatic group, for example a vinyl, halovinyl, styryl, acryloyl or methacryloyl group, or at least one polymerizable ring system. Examples of such groups are unsaturated groups containing halogen atoms, such as halomaleic acid radicals and halopropiolic acid radicals, α- or β-bromo- or chloro-acryloyl, halogenated vinylacetyl groups, halocrotonyl or halomethacryloyl groups. Also suitable are those groups which are readily converted, for example by elimination of hydrogen halide, into halogen-containing unsaturated groups, for example dichloropropionyl or dibromopropionyl. Halogen atoms are here to be understood as meaning fluorine, chlorine, bromine and iodine atoms but also pseudohalogen atoms, for example cyano. Examples of further detachable atoms or groups are ammonium including hydrazinium, sulfato, thiosulfato, phosphato, acetoxy, propionoxy or carboxypyridinium.

Suitable reactive UV absorbers for the process of the present invention are preferably compounds of the formula (26)

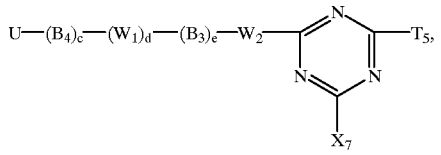

where $B_3$ and $B_4$ are each independently of the other an aliphatic bridge member; U is the radical of a UV absorber from the group of the 2-hydroxybenzophenones, benzotriazoles, 2-hydroxyphenyl-1,3,5-triazines, oxalodiamides, acrylates, substituted or unsubstituted benzoic acids and esters and radicals of the formula (27)

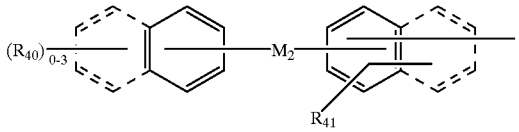

where $(R_{40})_{0-3}$ represents 0 to 3 identical or different radicals $R_{40}$ selected from the group consisting of sulfo, $C_1$–$C_4$alkyl, $C_1$–$C_4$alkoxy, halogen, hydroxyl, carboxyl, nitro and $C_1$–$C_4$alkylcarbonylamino, $R_{41}$ is hydrogen, sulfo, $C_1$–$C_4$alkyl or $C_1$–$C_4$alkoxy, $M_2$ is a group —$NR_{30}$—CO— or —$NR_{30}$—$SO_2$—, $R_{30}$ is hydrogen or $C_1$–$C_4$alkyl, $W_2$ is a group —$NR_{42}$—, —O— or —S—, $R_{42}$ is hydrogen or substituted or unsubstituted $C_1$–$C_4$alkyl, $W_1$ is a radical —C(O)O—, —O(O)C—, —C(O)NH— or —HN(O)C—, $X_7$ is halogen, hydroxyl, sulfo, $C_1$–$C_4$alkylsulfonyl, phenylsulfonyl, substituted or unsubstituted amino, 3-carboxypyridin-1-yl or 3-carbamoylpyridin-1-yl, $T_5$ independently has one of the meanings indicated for $X_7$ or is an optionally further substituted alkoxy, aryloxy, alkylthio or arylthio radical or is a nitrogen-containing heterocyclic radical or is a reactive radical of the formula (28a)

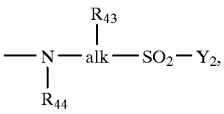

(28b)

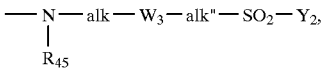

(28c)

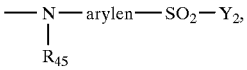

-continued (28d)

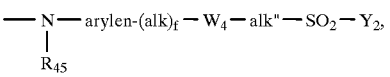

(28e)

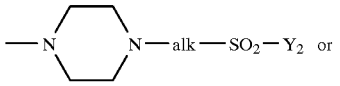

(28f)

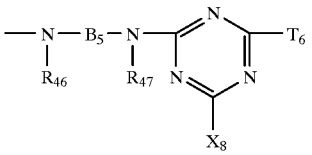

where $B_5$ is an aliphatic, cycloaliphatic, aromatic or aromatic-aliphatic bridge member or together with —$NR_{46}$— or —$NR_{47}$— is a heterocyclic ring, $R_{46}$ and $R_{47}$ are each independently of the other hydrogen or substituted or unsubstituted $C_1$–$C_4$alkyl, $X_8$ is halogen, hydroxyl, substituted or unsubstituted amino, 3-carboxypyridin-1-yl or 3-carbamoylpyridin-1-yl, $T_6$ independently has one of the meanings indicated for $X_8$ or is an optionally further substituted alkoxy, aryloxy, alkylthio or arylthio radical or is a nitrogen-containing heterocyclic radical or independently a radical U—$(B_4)_c$—$(W_1)_d$—$(B_3)_e$—$W_2$—, where U, $B_4$, $B_3$, $W_1$ and $W_2$ are each as defined above, $R_{44}$ is hydrogen, unsubstituted or hydroxyl-, sulfo-, sulfato-, carboxyl- or cyano-substituted $C_1$–$C_4$alkyl or a radical

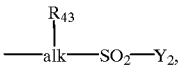

$R_{45}$ is hydrogen or $C_1$–$C_4$alkyl, $R_{43}$ is hydrogen, hydroxyl, sulfo, sulfato, carboxyl, cyano, halogen, $C_1$–$C_4$alkoxycarbonyl, $C_1$–$C_4$alkanoyloxy, carbamoyl or the group —$SO_2$—$Y_2$, alk and alk" are independently of each other $C_1$–$C_7$alkylene, arylen is an unsubstituted or sulfo-, carboxyl-, $C_1$–$C_4$alkyl-, $C_1$–$C_4$alkoxy- or halogen-substituted phenylene or naphthylene radical, $Y_2$ is vinyl or a radical —$CH_2$–$CH_2$—$Z_2$ and $Z_2$ is a leaving group, $W_3$ is —O— or —$NR_{45}$—, $W_4$ is a group —$SO_2$—$NR_{44}$—, —$CONR_{44}$— or —$NR_{44}CO$—, and c, d, e and f are each independently of the others 0 or 1, with d being 0 when e is 0, with the proviso that the compounds of the formula (26) have at least one sulfo or sulfato group and at least one alkali-detachable group.

An aliphatic bridge member $B_3$ or $B_4$ is for example a straight-chain or branched $C_1$–$C_{12}$alkylene, preferably a straight-chain or branched $C_1$–$C_6$alkylene. Examples of particularly preferred alkylene radicals $B_3$ and $B_4$ are methylene, 1,2-ethylene, 1,2-propylene, 1,3-propylene, 1,4-butylene, 2-methyl-1,5-pentylene and 1,6-hexylene, in particular methylene and 1,2-ethylene.

An aliphatic bridge member $B_5$ can be for example straight-chain or branched and optionally hydroxyl-, sulfo- or sulfato-substituted and/or —O-interrupted $C_2$–$C_{12}$alkylene. Preferably $B_5$ is straight-chain or branched $C_2$–$C_6$alkylene which may be substituted by hydroxyl, sulfo or sulfato. Examples of particularly preferred alkylene radicals $B_5$ are 1,2-ethylene, 1,2-propylene, 1,3-propylene, 2-hydroxy-1,3-propylene, 1,4-butylene, 2-methyl-1,5-pentylene and 1,6-hexylene.

A cycloaliphatic bridge member $B_5$ is for example cyclohexylene or the radical of the formula (29)

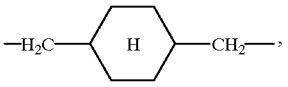

or —$NR_{46}$— and —$NR_{47}$— are combined with $B_5$ into a ring, for example a piperazine ring.

Examples of aromatic bridge members $B_5$ are unsubstituted or, for example, sulfo-, carboxyl-, $C_1$–$C_4$alkyl-, $C_1$–$C_4$alkoxy- or halogen-substituted 1,2-, 1,3- or 1,4-phenylene, unsubstituted or sulfo-substituted naphthylene or a radical of the formula (30)

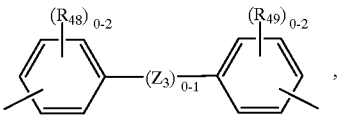

where $Z_3$ is for example —CO—, —NHCO—, —NHCONH—, —$(CH)_{1-4}$—, —NH—, —CH═CH—, —O—, —$SO_2$— or —N═N—; and $(R_{48})_{0-2}$ and $(R_{49})_{0-2}$ independently of each other represent 0 to 2 identical or different radicals selected from the group consisting of sulfo, methyl, methoxy and chlorine.

Preferable for use as aromatic bridge member $B_5$ are unsubstituted or sulfo-, carboxyl-, chlorine-, methyl- or methoxy-substituted 1,3- or 1,4-phenylene, naphthylene substituted by 1 or 2 sulfo groups, or a radical of the formula (30a)

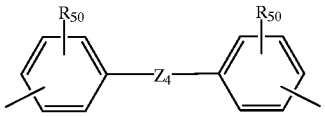

or (30b)

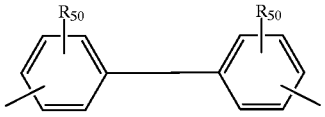

where $Z_4$ is —NHCONH—, —O—, —NH—, —CH═CH— or —$CH_2$—; and $R_{50}$ is hydrogen or sulfo.

Examples of particularly preferred aromatic bridge members $B_5$ are 1,3-phenylene, 1,4-phenylene, 4-methylphenylene-1,3,4-sulfophenylene-1,3,3-sulfophenylene-1,4, 3,6-disulfophenylene-1,4,4,6-disulfophenylene-1,3,3,7-disulfonaphthylene-1,5, 4,8-disulfonaphthylene-2,6,2,2'-disulfodiphenylene-4,4', 4,4'phenyleneurea-2,2'-disulfonic acid or 2,2'-disulfostilbenylene-4,4' and in particular 4-sulfophenylene-1,3,3-sulfophenylene-1,4,3,6-disulfophenylene-1,4 or 4,6-disulfophenylene-1,3.

An example of aromatic-aliphatic bridge members $B_5$ is phenylene-$C_1$–$C_4$alkylene, unsubstituted or substituted in the phenylene moiety, for example by sulfo, methyl, methoxy, carboxyl or chlorine. An aromatic-aliphatic bridge member B is preferably unsubstituted phenylenemethylene or phenylenemethylene substituted by sulfo, methyl or methoxy in the phenylene moiety.

$B_5$ is preferably $C_2$–$C_6$alkylene, which may be substituted by hydroxyl, sulfo or sulfato, unsubstituted or sulfo-, carboxyl-, chlorine-, methyl- or methoxy-substituted 1,3- or 1,4-phenylene, naphthylene substituted by 1 or 2 sulfo groups, or a radical of the formula (30a)

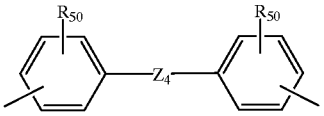

or (30b)

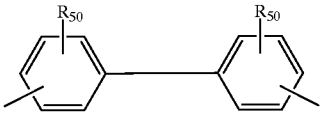

where $Z_4$ is —NHCONH—, —O—, —NH—, —CH═CH— or —$CH_2$—; and $R_{50}$ is hydrogen or sulfo.

Particularly preferably $B_5$ is 4-sulfophenylene-1,3,3-sulfophenylene-1,4, 3,6-disulfophenylene-1,4 or 4,6-disulfophenylene-1,3.

$R_{46}$ and $R_{47}$ are each independently of the other for example hydrogen or unsubstituted or, for example, halogen-, hydroxyl-, cyano-, $C_1$–$C_4$alkoxy-, $C_1$–$C_4$alkoxycarbonyl-, carboxyl-, sulfamoyl-, sulfo- or sulfato-substituted $C_1$–$C_4$alkyl. Preferably $R_{46}$ and $R_{47}$ are each independently of the other hydrogen or $C_1$–$C_4$alkyl, particularly preferably hydrogen, methyl or ethyl.

c and d are each preferably 0.

$R_{42}$ is for example hydrogen or unsubstituted or, for example, halogen-, hydroxyl-, cyano-, $C_1$–$C_4$alkoxy-, $C_1$–$C_4$alkoxycarbonyl-, carboxyl-, sulfamoyl-, sulfo- or sulfato-substituted $C_1$–$C_4$alkyl. Preferably $R_{42}$ is hydrogen or $C_1$–$C_4$alkyl, particularly preferably hydrogen, methyl or ethyl.

A 2-hydroxyphenyl-1,3,5-triazine radical U has for example the formula (31)

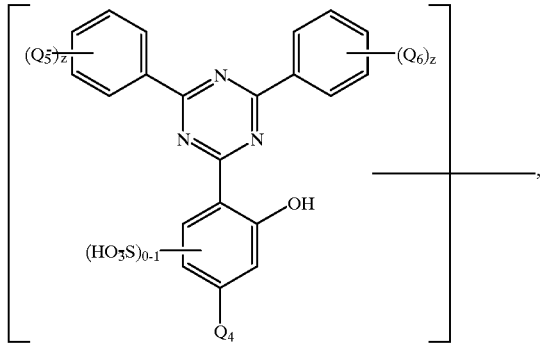

where z is an integer from 1 to 3 and $Q_4$, $Q_5$ and $Q_6$ are each independently of the others hydrogen, hydroxyl, $C_1$–$C_{12}$alkyl, $C_1$–$C_{,8}$alkoxy or unsubstituted or hydroxyl-substituted $C_1$–$C_4$alkoxy-$C_1$–$C_4$alkoxy.

Examples of suitable 2-hydroxyphenyl-1,3,5-triazine radicals U are the radical of 2,4,6-tris(2-hydroxy-4-octyloxyphenyl)-1,3,5-triazine, 2-(2-hydroxy-4-octyloxyphenyl)-4,6-bis(2,4-dimethylphenyl)-1,3,5-triazine, 2-(2,4-dihydroxyphenyl)-4,6-bis(2,4-dimethylphenyl)-1,3,5-triazine, 2,4-bis(2-hydroxy-4-propyloxyphenyl)-6-(2,4-dimethylphenyl)-1,3,5-triazine, 2-(2-hydroxy-4-octyloxyphenyl)-4,6-bis(4-methylphenyl)-1,3,5-triazine, 2-(2-hydroxy-4-dodecyloxyphenyl)-4,6-bis(2,4-dimethylphenyl)-1,3,5-triazine, 2-[2-hydroxy-4-(2-hydroxy-3-butyloxypropyloxy)phenyl]-4,6-bis(2,4-dimethylphenyl)-1,3,5-triazine, 2-(2-hydroxy-4-methoxy-6-sulfophenyl)-4,6-bis(phenyl)-1,3,5-triazine or 2-[2-hydroxy-4-(2-hydroxy-3-octyloxypropyloxy)phenyl]-4,6-bis(2,4-dimethylphenyl)-1,3,5-triazine.

The benzotriazole radical U has for example the formula (32)

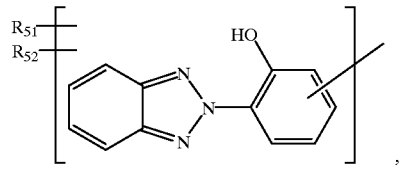

where $R_{51}$ and $R_{52}$ are independently of each other hydrogen; $C_1$–$C_4$alkyl; $C_1$–$C_4$alkoxy; halogen; hydroxyl; nitro; sulfo or carboxyl.

A 2-hydroxybenzophenone radical U has for example the formula (33)

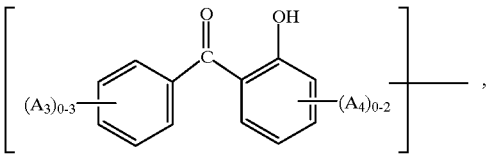

where $(A_3)_{0-3}$ represents 0 to 3 identical or different radicals selected from the group consisting of halogen, hydroxyl, sulfo, $C_1$–$C_{12}$alkoxy or phenyl-$C_1$–$C_4$alkoxy and $(A_4)_{0-2}$ represents 0 to 2 identical or different radicals selected from the group consisting of halogen, hydroxyl, sulfo, $C_1$–$C_{12}$alkoxy or phenyl-$C_1$–$C_4$alkoxy.

Examples of suitable 2-hydroxybenzophenone radicals U are the radical of 2,4-dihydroxy-, 2-hydroxy-4-methoxy-, 2-hydroxy-4-octoxy-, 2-hydroxy-4-decyloxy-, 2-hydroxy-4-dodecyloxy-, 2-hydroxy-4-methoxy-5-sulfo-, 2-hydroxy-4-benzyloxy-, 4,2',4'-trihydroxy- or 2'-hydroxy-4,4'-dimethoxy-benzophenone.

An oxalanilide radical U has for the example the formula (34)

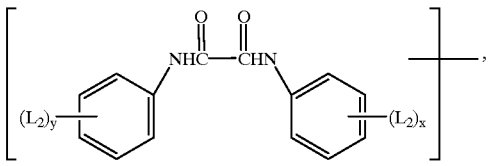

where x and y are each independently of the other an integer from 0 to 3 subject to the proviso that the sum of $(x+y) \geqq 1$, and each substituent $L_2$ is independently of the others sulfo; alkyl, alkoxy or alkylthio each with 1 to 22 carbon atoms and unsubstituted or substituted in the alkyl moiety by sulfo; or phenoxy or phenylthio unsubstituted or substituted on the phenyl ring by sulfo.

Examples of suitable oxalanilide radicals U are the radical of 4,4'-dioctyloxyoxanilide, 2,2'-diethoxyoxanilide, 2,2'-dioctyloxy-5,5'-di-tert-butyl-oxanilide, 2,2'-di-dodecyloxy-5,5'di-tert-butyl-oxanilide, 2-ethoxy-2'-ethyloxanilide, 2-methoxy-5-sulfooxanilide, 2-ethoxy-5-sulfooxanilide, 2,5-dimethoxyoxanilide, 2-ethoxy-5-tert-butyl-2'-ethyloxanilide alone or mixed with the radical of 2-ethoxy-2'-ethyl-5,4'-di-tert-butyl-oxanilide, or mixtures of the radicals of o- and p-methoxy- and also of o- and p-ethoxy-disubstituted oxanilides.

Suitable acrylate radicals U are $C_1$–$C_{10}$alkyl acrylates which are unsubstituted or substituted by cyano or carbo-$C_1$–$C_4$alkoxy in the α-position, carry a phenyl, $C_1$–$C_4$alkoxyphenyl or indolinyl radical in one β-position and are unsubstituted or substituted by phenyl, $C_1$–$C_4$alkoxyphenyl or $C_1$–$C_4$alkyl in the other β-position.

Examples of acrylate radicals U are the radical of ethyl or isooctyl α-cyano-β,β-diphenylacrylate, methyl α-carbomethoxycinnamate, methyl or butyl α-cyano-β-methyl-p-methoxycinnamate, methyl α-carbomethoxy-p-methoxycinnamate or N-(β-carbomethoxy-p-cyanovinyl)-2-methylindoline.

A substituted or unsubstituted benzoic acid or ester radical U is for example an unsubstituted or hydroxyl- or $C_1$–$C_4$alkyl-substituted benzoic acid radical or its phenyl, $C_1$–$C_8$alkylphenyl or $C_1$–$C_{18}$alkyl ester. Examples are the radical of benzoic acid, 4-tert-butylphenyl salicylate, phenyl salicylate, octylphenyl salicylate, dibenzoylresorcinol, bis(4-tert-butylbenzoyl)resorcinol, benzoylresorcinol, 2,4-di-tert-butylphenyl 3,5-di-tert-butyl-4-hydroxybenzoate, hexadecyl 3,5-di-tert-butyl-4-hydroxybenzoate, octadecyl 3,5-di-tert-butyl-4-hydroxybenzoate or 2-methyl-4,6-di-tert-butylphenyl 3,5-di-tert-butyl-4-hydroxybenzoate.

When U is a radical of the above-indicated formula (27), $(R_{40})_{0-3}$ preferably denotes 0 to 3 identical or different radicals $R_{40}$ selected from the group consisting of sulfo, methyl, methoxy, hydroxyl and carboxyl, $R_{41}$ is preferably hydrogen, and $M_2$ is preferably a group —NH—CO— or —NH—$SO_2$—. U is in this case preferably a radical of the formula (27a)

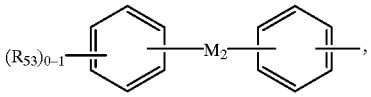

where $(R_{53})0$-1 denotes 0 or 1 radical $R_{53}$ selected from the group consisting of sulfo, methyl, methoxy, hydroxyl and carboxyl and $M_3$ is a group —NH—CO— or —NH—$SO_2$—.

Particularly preferably U is the radical of an oxalic diarylamide of the formula (35)

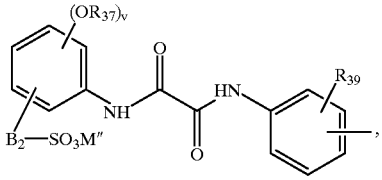

where $R_{37}$ is unsubstituted or hydroxyl- or alkoxy-substituted $C_1$–$C_5$alkyl or unsubstituted or $C_1$–$C_5$alkyl-substituted benzyl;

$R_{39}$ is hydrogen; halogen; $C_1$–$C_{12}$alkyl; phenyl-$C_1$–$C_5$alkyl or $C_1$–$C_5$alkoxy;

$B_2$ is a direct bond or a bivalent radical of the formula-O—$L_3$—, where $L_3$ is unsubstituted or hydroxyl-substituted $C_1$–$C_6$alkylene;

M" is hydrogen or an alkali metal and v is 2; 1or 0.

A $C_1$–$C_5$alkyl $R_{37}$ is for example methyl, ethyl, n-propyl, isopropyl, n-butyl, sec-butyl, tert-butyl, amyl or isoamyl;

A halogen $R_{39}$ is for example fluorine, bromine or chlorine. Chlorine is preferred. A $C_1$–$C_{12}$alkyl $R_{39}$ can be branched or unbranched radicals, for example, methyl, ethyl, n-propyl, isopropyl, n-butyl, sec-butyl, tert-butyl, amyl, isoamyl, pentyl, neopentyl, tert-pentyl, hexyl, isohexyl, heptyl, octyl, isooctyl, nonyl, decyl, undecyl or dodecyl. A phenyl-$C_1$–$C_5$alkyl $R_{39}$ is for example phenethyl, phenylpropyl, phenylbutyl or preferably benzyl.

A $C_1$–$C_5$alkoxy $R_{39}$ is for example methoxy, ethoxy, isopropoxy, isobutoxy, tert-butoxy or tert-amyloxy.

A $C_1$–$C_6$alkylene $L_3$ is a bivalent saturated hydrocarbon radical, for example methylene, ethylene, propylene, trimethylene, tetramethylene, ethylethylene, pentamethylene or hexamethylene.

An alkali metal M" is for example lithium, sodium or potassium. Sodium is preferred.

Particularly suitable for use as a radical of the oxalic diarylamide of the formula (35) is a compound in which $L_3$ is trimethylene or

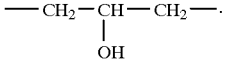

A further preferred oxalic diarylamide radical conforms to the above-indicated formula (35) where $R_{39}$ is hydrogen, $C_1$–$C_{12}$alkyl or $C_1$–$C_5$alkoxy. Likewise preferred is an oxalic diarylamide radical of the above-indicated formula (35) where $R_{37}$ is $C_1$–$C_3$alkyl;

$R_{39}$ is hydrogen, $C_1$–$C_3$alkyl or $C_1$–$C_3$alkoxy;

$B_2$ is a direct bond or the radical —[O—$(CH_2)_3]_m$; and m is 0 or 1.

Very particular preference for use as oxalic diarylamide radical is given to a compound of the formula (35) where v is 0 or 1;

$R_{37}$ is methyl or ethyl;

$R_{39}$ is hydrogen or $C_1$–$C_3$alkoxy; and $B_2$ is a direct bond.

The reactive UV absorbers of the formula (26) are known or can be prepared for example by reacting a compound of the formula $$U—(B_4)_c—(W_1)_d—(B_3)_e—W_2—H \quad (36),$$

a compound of the formula (37)

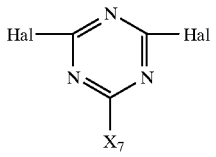

and a compound of the formula $$T_5^*—H \quad (38)$$

where U, $B_3$, $B_4$, $W_1$, $W_2$, $X_7$, c, d and e are each as defined above, Hal is halogen, preferably fluorine or chlorine, and $T_5^*$ has the meanings indicated above for $T_5$ other than halogen, with one another, the order of the elementary reactions being freely choosable having regard to the starting compounds to be reacted with one another.

The application of the reactive UV absorbers can take place before, during or after the application of the direct dyes (dyeing), by an exhaust or continuous process. The application during dyeing is preferred. Particular preference is given to applying the UV absorbers together with the direct dyes.

Preference for the process of the present invention is given to combinations of dyes containing the radicals of the formulae (4a), (4b), (5a), (5b), (6), (7), (8), (9a) or (9b) with UV absorbers of the formulae (10), (11), (12) or (13).

Particular preference for the process of the present invention is given to combinations of dyes containing the radicals of the formulae (4a), (4b), (5a), (5b), (6), (7), (8), (9a) or (9b) with reactive UV absorbers of the formula (26).

Very particular preference for the process of the present invention is given to combinations of dyes containing the radicals of the formulae (4a), (4b), (5a), (5b), (6), (7), (8), (9a) or (9b) with reactive UV absorbers of the formula (26) where U is the radical of the formula (35).

Cellulosic fibre materials are to be understood as meaning for example the natural cellulose fibre, such as cotton, linen and hemp, and also cellulose pulp and regenerated cellulose. The direct dyes are also suitable for treating hydroxyl-containing fibres present in blend fabrics, for example blends of cotton with polyester fibres or polyamide fibres. Cellulosic fibre materials having a density between 30 and 200 g/m$^2$ are preferred for the use according to the present invention. Cotton is the preferred cellulosic fibre material. The fibres mentioned can be present in various forms, for example as staple or yarns or as wovens or knits.

The direct dyes can be applied to the fibre material and fixed on the fibre in various ways, in particular in the form of aqueous dye solutions and print pastes. They are suitable not only for the exhaust process but also for dyeing by the pad-dyeing process, whereby the material is impregnated with aqueous dye solutions with or without a salt content and the dyes are fixed after an alkali treatment or in the presence of alkali with or without heating. After fixing, the dyeings or prints are thoroughly rinsed with cold and hot water in the presence or absence of an agent which has a dispersing effect and promotes the diffusion of the unfixed portions. The customary dyeing and printing processes are employed.

The dyeing liquors may contain the generally customary additives, for example the aqueous solutions of inorganic salts, for example of alkali metal chlorides or alkali metal sulfates, alkali metal hydroxides, ureas, thickenings, for example alginate thickenings, water-soluble cellulose alkyl ethers and also dispersing, levelling and deaerating auxiliaries, antifoams, penetration accelerants and migration inhibitors, also sodium m-nitrobenzenesulfonate and, as further thickeners, for example methylcellulose, starch ethers, emulsion thickenings, preferably an alginate, for example sodium alginate, and also wetting agents.

Preference for the use according to the present invention is given to dyeing by the exhaust method. Exhaust dyeing generally takes place in an aqueous medium, at a liquor ratio of, for example, 2:1 to 60:1, in particular a liquor ratio of 5:1 to 20:1, a dyebath pH of, for example, 6 to 13 and a temperature of, for example, 40 to 120° C., in particular a temperature of 60 to 95° C.

The cellulose fibre materials treated with the direct dyes and UV absorbers are notable for a very high sun protection factor. The sun protection factor is defined as the ratio of the harmful dose of UV energy on protected skin to the harmful dose of UV energy on unprotected skin. Accordingly, a sun protection factor is also a measure of the UV transmissivity of untreated fibre materials and of fibre materials treated with the direct dyes and UV absorbers used in this invention. The UV transmissivity of fibre materials can be measured for example in a transmission measurement using a double monochromator spectrophotometer equipped with an Ulbricht sphere.

The sun protection factor can be calculated for example by the method described by B. L. Diffey and J. Robson in J. Soc. Cosmet. Chem. 40, 127–133 (May/June 1989).

The examples which follow illustrate the invention. The temperatures are indicated in degrees Celsius. Parts and percentages are by weight, unless otherwise stated. Parts by weight relate to parts by volume as the kilogram to the liter.

EXAMPLE 1

Twelve specimens, each weighing 10 g, of a bleached cotton tricot having a weight of 185 g/m$^2$ and a thickness of 0.85 mm are treated individually in an AHIBA® dyeing machine at a liquor ratio of 25:1 in twelve different liquors.

Liquor 1 contains 0.013 g of a direct dye which, in the form of the free acid, conforms to the following formula:

(100)

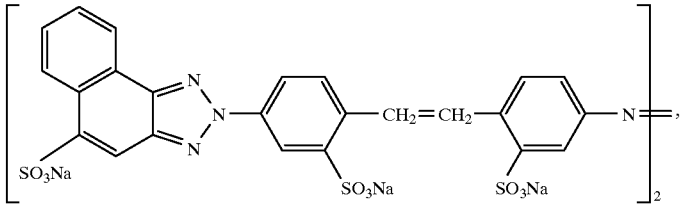

0.5 g/l of a commercial dyeing auxiliary, for example a penetration accelerant, and 0.5 g/l of calcined sodium carbonate.

Liquor 2 corresponds to liquor 1, but additionally contains 0.075 g of a UV absorber of the formula (200)

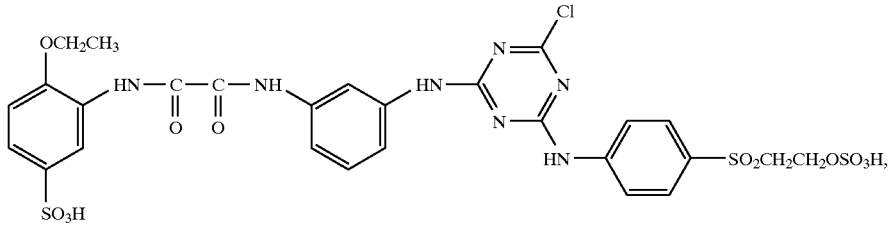

Liquor 3 contains 0.011 g of a direct dye which, in the form of the free acid, conforms to the following formula:

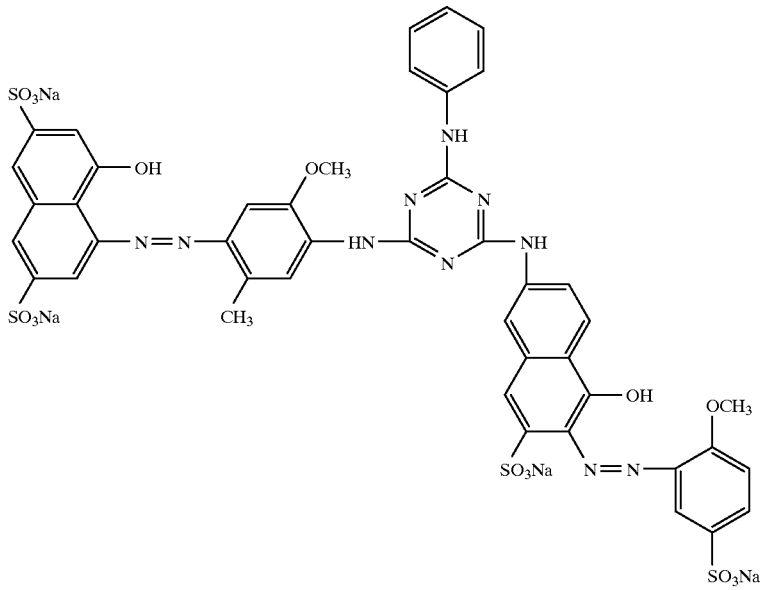

0.5 g/l of a commercial dyeing assistant, for example a penetration accelerant, and 0.5 g/l of calcined sodium carbonate.

Liquor 4 corresponds to liquor 3, but additionally contains 0.075 g of a UV absorber of the formula (200).

Liquor 5 contains 0.01 g of a direct dye which, in the form of the free acid, conforms to the following formula:

(102)

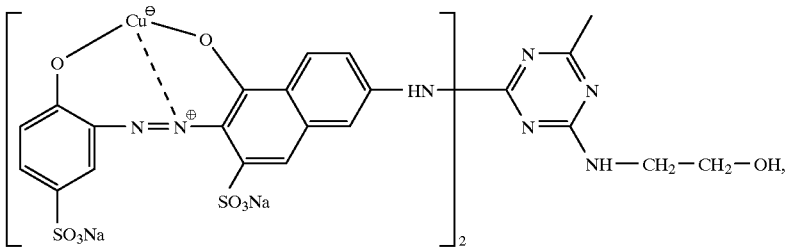

0.5 g/l of a commercial dyeing assistant, for example a penetration accelerant, and 0.5 g/l of calcined sodium carbonate.

Liquor 6 corresponds to liquor 5, but additionally contains 0.075 g of a UV absorber of the formula (200).

Liquor 7 contains 0.008 g of a direct dye which, in the form of the free acid, conforms to the following formula:

(103)

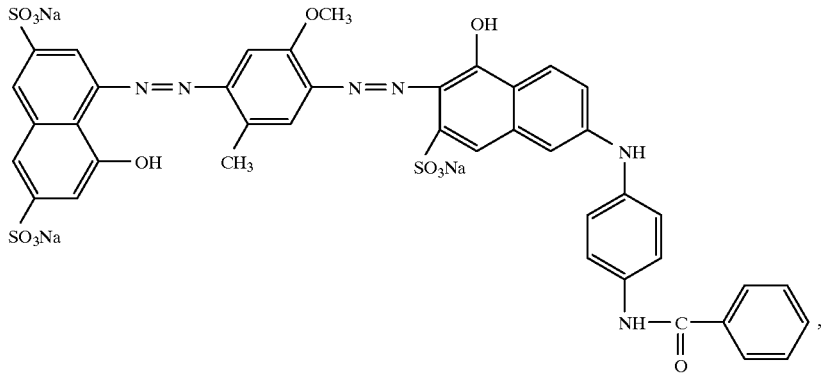

0.5 g/l of a commercial dyeing assistant, for example a penetration accelerant, and 0.5 g/l of calcined sodium carbonate.

Liquor 8 corresponds to liquor 7, but additionally contains 0.075 g of a UV absorber of the formula (200).

Liquor 9 contains 0.009 g of a direct dye which, in the form of the free acid, conforms to the following formula:

(104)

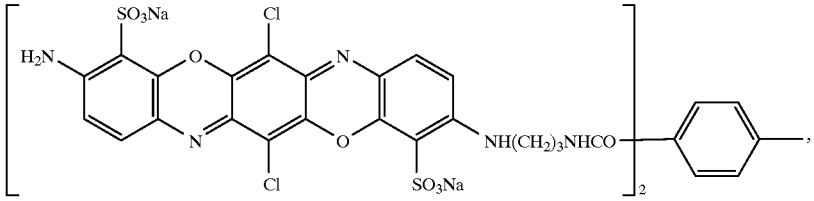

0.5 g/l of a commercial dyeing assistant, for example a penetration accelerant, and 0.5 g/l of calcined sodium carbonate.

Liquor 10 corresponds to liquor 9, but additionally contains 0.075 g of a UV absorber of the formula (200).

Liquor 11 contains 0.008 g of a direct dye which, in the form of the free acid, conforms to the following formula:

(105)

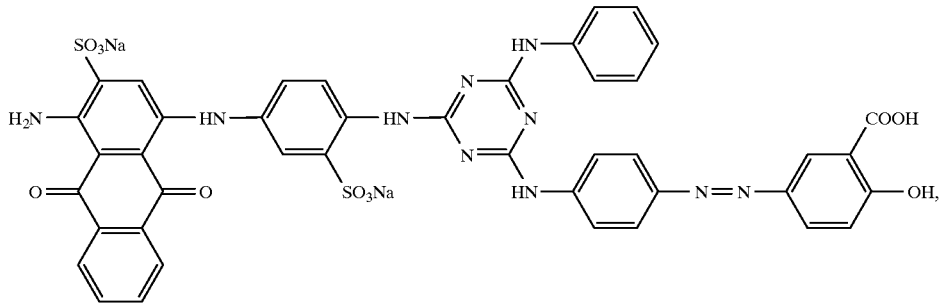

0.5 g/l of a commercial dyeing assistant, for example a penetration accelerant, and 0.5 g/l of calcined sodium carbonate.

Liquor 12 corresponds to liquor 11, but additionally contains 0.075 g of a UV absorber of the formula (200).

The cotton tricot specimens are introduced into the dyeing liquors at 40° C.; after 5 minutes the dyebath is heated up at a rate of 2° C./minute to a temperature of 95° C. and left at that temperature for 60 minutes. At 10 minutes and 20 minutes from the attainment of 95° C. 5 g/l of sodium chloride is added each time.

Following a total dyeing time of 45 minutes, the liquors are cooled down to 60° C., the dyed specimens are removed from the liquors, rinsed with cold water, centrifuged and then dried at 100° C.

Thereafter the transmission spectra of the specimens are measured in the UV region and the sun protection factors determined. The sun protection factors found are reproduced in Table 1.

TABLE 1

| Specimen treated with | Sun protection factor according to | |
|---|---|---|
| liquor No. | CIE D 65 | CIE S. Europe |
| untreated | 7 | 8 |
| 1 | 41 | 41 |
| 2 | 182 | 198 |
| 3 | 32 | 40 |
| 4 | 138 | 164 |
| 5 | 44 | 50 |
| 6 | 176 | 207 |
| 7 | 28 | 31 |
| 8 | 141 | 180 |
| 9 | 13 | 14 |
| 10 | 203 | 270 |
| 11 | 40 | 42 |
| 12 | 138 | 154 |

EXAMPLE 2

Example 1 is repeated, except that in liquors 2, 4, 6, 8, 10 and 12 the 0.075 g of the UV absorber of the formula (200) is replaced by the same amount of a UV absorber of the formula (201)

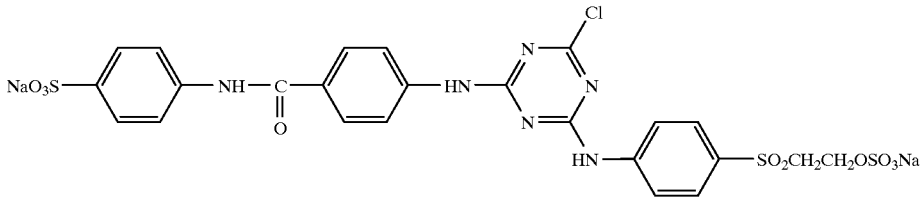

The sun protection factors found for the twelve specimens are reproduced in Table 2:

TABLE 2

| Specimen treated with | Sun protection factor according to | |
|---|---|---|
| liquor No. | CIE D 65 | CIE S. Europe |
| untreated | 7 | 8 |
| 1 a | 41 | 41 |
| 2 a | 145 | 198 |
| 3 a | 32 | 40 |
| 4 a | 114 | 177 |
| 5 a | 44 | 50 |
| 6 a | 134 | 211 |
| 7 a | 28 | 31 |
| 8 a | 89 | 136 |
| 9 a | 13 | 14 |
| 10 a | 74 | 125 |
| 11 a | 40 | 42 |
| 12 a | 152 | 206 |

EXAMPLE 3

Examples 1 and 2 are repeated with the 0.85 mm 185 g/m$^2$ bleached cotton tricot replaced by a cotton cretonne having a weight of 135 g/m$^2$ and a thickness of 0.2 mm.

The sun protection factors found for the eighteen specimens are reproduced in Table 3:

TABLE 3

| Specimen treated with liquor No. | Sun protection factor according to CIE D 65 | CIE S. Europe |
|---|---|---|
| untreated | 4 | 4 |
| 1' | 12 | 12 |
| 2' | 29 | 31 |
| 2a' | 34 | 38 |
| 3' | 12 | 14 |
| 4' | 26 | 28 |
| 4a' | 24 | 31 |
| 5' | 15 | 16 |
| 6' | 25 | 27 |
| 6a' | 24 | 29 |
| 7' | 8 | 9 |
| 8' | 24 | 27 |
| 8a' | 24 | 31 |
| 9' | 6 | 7 |
| 10' | 29 | 32 |
| 10a' | 25 | 32 |
| 11' | 13 | 14 |
| 12' | 27 | 29 |
| 12a' | 35 | 40 |

What is claimed is:

1. A process which increases the Sun Protection Factor of an undyed cellulosic fibre material by at least a factor of 5, which comprises treating the cellulosic fibre material with 0.001 to 0.2% by weight, based on the weight of the fibre material of at least one direct dye, and with 0.2 to 2% by weight, based on the weight of the fibre material of at least one UV absorber, or treating the cellulosic fibre material with 0.2 to 2% by weight, based on the weight of the fibre material of at least one direct dye and 0.05 to 0.2% by weight, based on the weight of the fibre material of at least one UV absorber.

2. A process according to claim 1, wherein the cellulosic fibre material used is cotton.

3. A process as claimed in claim 1, wherein the cellulosic fibre material used has a density between 30 and 200 g/m$^2$.

4. A process according to claim 1, wherein the UV absorber used is a 2-hydroxybenzophenone of the formula (10)

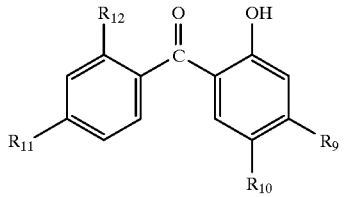

where $R_9$ is hydrogen, hydroxyl, $C_1$–$C_{14}$alkoxy or phenoxy, $R_{10}$ is hydrogen, halogen, $C_1$–$C_4$alkyl or sulfo, $R_{11}$ is hydrogen, hydroxyl or $C_1$–$C_4$alkoxy, and $R_{12}$ is hydrogen, hydroxyl or carboxyl.

5. A process according to claim 1, wherein the UV absorber used is a 2-(2'-hydroxyphenyl)benzotriazole of the formula (11)

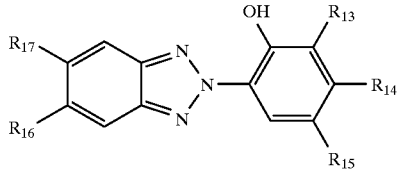

where $R_{13}$ is hydrogen, chlorine, sulfo, $C_1$–$C_{12}$alkyl, $C_5$–$C_6$cycloalkyl, ($C_1$–$C_8$alkyl)phenyl, $C_7$–$C_9$phenylalkyl or sulfonated $C_7$–$C_9$phenylalkyl, $R_{14}$ is hydrogen, chlorine, $C_1$–$C_4$alkyl, $C_1$–$C_4$alkoxy, hydroxyl or sulfo, $R_{15}$ is $C_1$–$C_{12}$alkyl, chlorine, sulfo, $C_1$–$C_4$alkoxy, phenyl, ($C_1$–$C_8$alkyl)phenyl, $C_5$–$C_6$cycloalkyl, $C_2$–$C_9$alkoxycarbonyl, carboxyethyl, $C_7$–$C_9$phenylalkyl or sulfonated $C_7$–$C_9$phenylalkyl, $R_{16}$ is hydrogen, chlorine, $C_1$–$C_4$alkyl, $C_1$–$C_4$alkoxy, $C_2$–$C_9$alkoxycarbonyl, carboxyl or sulfo, and $R_{17}$ is hydrogen or chlorine.

6. A process according to claim 1, wherein the UV absorber is used together with the direct dye.

7. A process according to claim 1, wherein the UV absorber used is a reactive UV absorber.

8. A process according to claim 1, wherein the direct dye used has the formula $$A_1—B_1—A_2 \quad (1)$$

where $B_1$ is a bridge member and $A_1$ and $A_2$ are independently of each other the radical of a monoazo, polyazo, metal complex azo, stilbene or anthraquinone dye, or where $B_1$ and $A_1$ are each as defined above and $A_2$ is a phenyl or naphthyl radical substituted by a heterocyclic radical or by a benzoylamino or phenylamino radical, or where $B_1$ is a direct bond and $A_1$ and $A_2$ are each the radical of a metal complex azo dye.

9. A process according to claim 8, wherein $A_1$ and $A_2$ are radicals of the formulae $$D_1—N{=}N—(M_1—N{=}N)_{\overline{0-1}}—K_1— \quad (4a)$$

or $$—D_1—N{=}N—(M_1—N{=}N)_{\overline{0-1}}—K_1, \quad (4b)$$

where $D_1$ is the radical of a diazo component of the benzene or naphthalene series, $M_1$ is the radical of a middle component of the benzene or naphthalene series, and $K_1$ is the radical of a coupling component of the benzene or naphthalene series.

10. A process according to claim 8, wherein $A_1$ and $A_2$ are radicals of the formulae (5a)

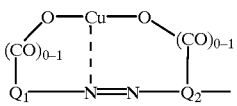

or (5b)

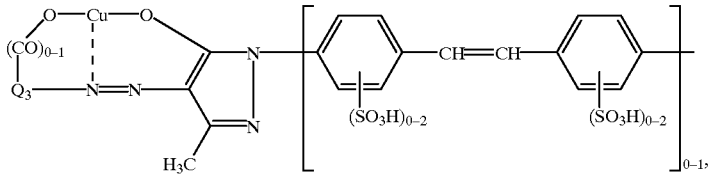

where the oxygen or the carboxyl group is bonded to the radical $Q_1$, $Q_2$ or $Q_3$ in an ortho position relative to the azo group and $Q_1$, $Q_2$ or $Q_3$ are each independently of the others a radical of the benzene or naphthalene series.

11. A process according to claim 8, wherein $A_1$ and $A_2$ are radicals of the formula (6)

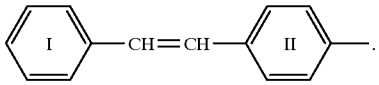

.

12. A process according to claim 8, wherein $A_1$ and $A_2$ are radicals of the formula (7)

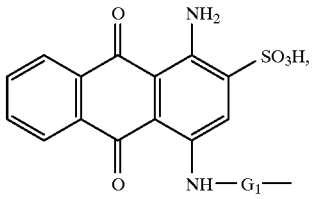

where $G_1$ is $C_2$–$C_6$alkylene, cyclohexylene, phenylenemethylene or phenylene.

13. A process according to claim 1, wherein the direct dye used is a phthalocyanide direct dye containing the radical of the formula (8)

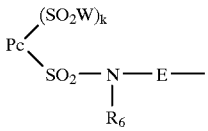

where Pc is the radical of a copper or nickel phthalocyanine, W is —OH and/or —$NR_7R_8$, $R_7$ and $R_8$ are independently of each other hydrogen or unsubstituted or hydroxyl- or sulfo-substituted $C_1$–$C_4$alkyl, $R_6$ is hydrogen or $C_1$–$C_4$alkyl, E is unsubstituted or $C_1$–$C_4$alkyl-, halogen-, carboxyl- or sulfo-substituted phenylene, or a $C_2$–$C_6$alkylene, and k is 1,2 or 3.

14. A process according to claim 1, wherein the direct dye used is a dioxazine direct dye containing the radicals of the formulae (9a)

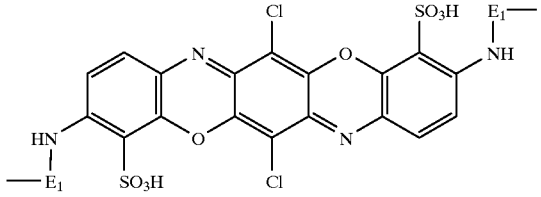

or (9b)

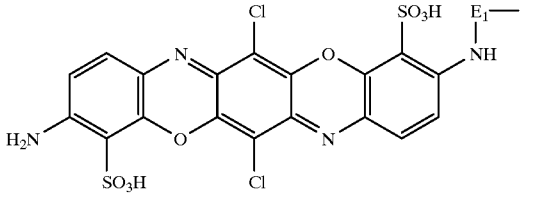

where $E_1$ is unsubstituted or $C_1$–$C_4$alkyl-, halogen-, carboxyl- or sulfo-substituted phenylene or a $C_2$–$C_6$alkylene.

15. A process according to claim 7, wherein the reactive UV absorber used is the compound of the formula (26)

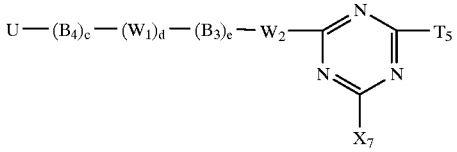

where $B_3$ and $B_4$ are each independently of the other an aliphatic bridge member, U is the radical of a UV absorber from the group of the 2-hydroxybenzophenones, benzotriazoles, 2-hydroxyphenyl-1,3,5-triazines, oxalodiamides, acrylates, substituted or unsubstituted benzoic acids and esters and radicals of the formula (27)

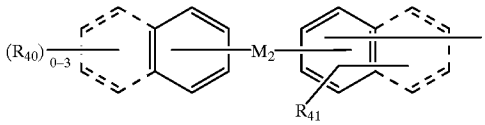

where $(R_{40})_{0-3}$ represents 0 to 3 identical or different radicals $R_{40}$ selected from the group consisting of sulfo, $C_1$–$C_4$alkyl, $C_1$–$C_4$alkoxy, halogen, hydroxyl, carboxyl, nitro and $C_1$–$C_4$alkylcarbonylamino, $R_{41}$ is hydrogen, sulfo, $C_1$–$C_4$alkyl or $C_1$–$C_4$alkoxy, $M_2$ is a group —$NR_{30}$—CO— or —$NR_{30}$—$SO_2$—, $R_{30}$ is hydrogen or $C_1$–$C_4$alkyl, $W_2$ is a group —$NR_{42}$—, —O— or —S—, $R_{42}$ is hydrogen or substituted or unsubstituted $C_1$–$C_4$alkyl, $W_1$ is a radical —C(O)O—, —O(O)C—, —C(O)NH— or —HN(O)C—, $X_7$ is halogen, hydroxyl, sulfo, $C_1$–$C_4$alkylsulfonyl, phenylsulfonyl, substituted or unsubstituted amino, 3-carboxypyridin-1-yl or 3-carbamoylpyridin-1-yl, $T_5$ independently has one of the meanings indicated for $X_7$ or is an optionally further substituted alkoxy, aryloxy, alkylthio or arylthio radical or is a nitrogen-containing heterocyclic radical or is a reactive radical of the formula (28a)

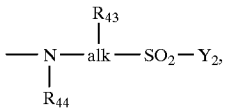

(28b)

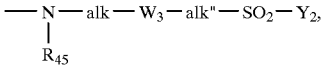

(28c)

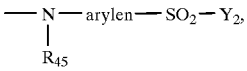

(28d)

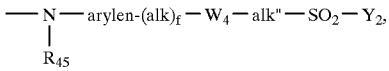

(28e)

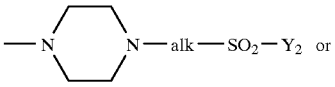

(28f)

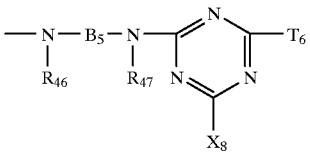

where $B_5$ is an aliphatic, cycloaliphatic, aromatic or aromatic-aliphatic bridge member or together with —$NR_{46}$— or —$NR_{47}$— is a heterocyclic ring, $R_{46}$ and $R_{47}$ are each independently of the other hydrogen or substituted or unsubstituted $C_1$–$C_4$alkyl, $X_8$ is halogen, hydroxyl, substituted or unsubstituted amino, 3-carboxypyridin-1-yl or 3-carbamoylpyridin-1-yl, $T_6$ independently has one of the meanings indicated for $X_8$ or is an optionally further substituted alkoxy, aryloxy, alkylthio or arylthio radical or is a nitrogen-containing heterocyclic radical or independently a radical U-$(B_4)_c$—$(W_1)_d$—$(B_3)_e$—$W_2$—, where U, $B_4$, $B_3$, $W_1$ and $W_2$ are each as defined above, $R_{44}$ is hydrogen, unsubstituted or hydroxyl-, sulfo-, sulfato-, carboxyl- or cyano-substituted $C_1$–$C_4$alkyl or a radical

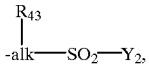

$R_{45}$ is hydrogen or $C_1$–$C_4$alkyl, $R_{43}$ is hydrogen, hydroxyl, sulfo, sulfato, carboxyl, cyano, halogen, $C_1$–$C_4$alkoxycarbonyl, $C_1$–$C_4$alkanoyloxy, carbamoyl or the group —$SO_2$—$Y_2$, alk and alk" are independently of each other $C_1$–$C_7$alkylene, arylen is an unsubstituted or sulfo-, carboxyl-, $C_1$–$C_4$alkyl-, $C_1$–$C_4$alkoxy- or halogen-substituted phenylene or naphthylene radical, $Y_2$ is vinyl or a radical —$CH_2$–$CH_2$—$Z_2$ and $Z_2$ is a leaving group, $W_3$ is —O— or —$NR_{45}$—, $W_4$ is a group —$SO_2$—$NR_{44}$—, —$CONR_{44}$— or —$NR_{44}$CO—, and c, d, e and f are each independently of the others 0 or 1, with d being 0 when e is 0, with the proviso that the compounds of the formula (26) have at least one sulfo or sulfato group and at least one alkali-detachable group.

16. A process according to claim 15, wherein the reactive UV absorber used is the compound of the formula (26) where U is a radical of an oxalic diarylamide of the formula (35)

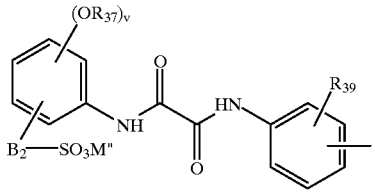

where $R_{37}$ is unsubstituted or hydroxyl- or alkoxy-substituted $C_1$–$C_5$alkyl or unsubstituted or $C_1$–$C_5$alkyl-substituted benzyl;

$R_{39}$ is hydrogen, halogen, $C_1$–$C_{12}$alkyl, phenyl-$C_1$–$C_5$alkyl or $C_1$–$C_5$alkoxy, $B_2$ is a direct bond or a bivalent radical of the formula —O——$L_3$—, where $L_3$ is unsubstituted or hydroxyl-substituted $C_1$–$C_6$alkylene, M" is hydrogen or an alkali metal and v is 2, 1 or 0.

17. A process according to claim 1, wherein the UV absorber used is a 2-(2'-hydroxyphenyl)-s-triazine of the formula (12)

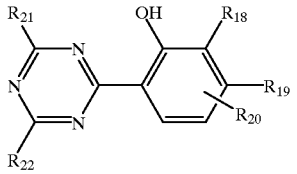

where $R_{18}$ is hydrogen, halogen, $C_1$–$C_4$alkyl or sulfo,$R_{19}$ is hydrogen, $C_1$–$C_4$alkyl, $C_1$–$C_4$alkoxy or hydroxyl, $R_{20}$ is hydrogen or sulfo, and $R_{21}$ and $R_{22}$ are independently of each other $C_1$–$C_4$alkyl, $C_1$–$C_4$alkoxy, $C_5$–$C_6$cycloalkyl, phenyl or $C_1$–$C_4$alkyl- and/or hydroxyl-substituted phenyl.

18. A process according to claim 1, wherein the UV absorber used is an s-triazine compound of the formula (13)

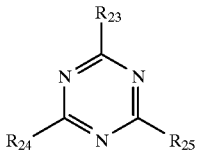

where at least one of the substituents $R_{23}$, $R_{24}$ and $R_{25}$ is a radical of the formula (14)

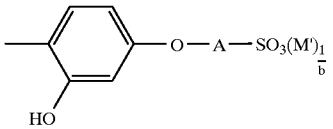

where A is $C_3$–$C_4$alkylene or 2-hydroxytrimethylene and M' is sodium, potassium, calcium, magnesium, ammonium or tetra-$C_1$–$C_4$alkylammonium and b is 1 or 2, and the remaining substituent is or the remaining substituents are independently of each other $C_1$–$C_{12}$alkyl, phenyl, $C_1$–$C_{12}$alkyl or phenyl attached to the triazinyl radical by oxygen, sulfur, imino or $C_1$–$C_{11}$alkylimino, or a radical of the formula (14).

* * * * *